US006164473A

United States Patent [19]

Waldrip

[11] Patent Number: 6,164,473

[45] **Date of Patent: *Dec. 26, 2000**

[54] BEVERAGE CONTAINER/DRINKING VESSEL

[76] Inventor: R. Leland Waldrip, 7004 Tapps Ford Rd., Amissville, Va. 20106

[ * ] Notice: This patent issued on a continued prosecution application filed under 37 CFR 1.53(d), and is subject to the twenty year patent term provisions of 35 U.S.C. 154(a)(2).

[21] Appl. No.: 09/056,862

[22] Filed: Apr. 8, 1998

[51] Int. Cl.[7] ..... B65D 1/02; B65D 1/06

[52] U.S. Cl. ..... 215/378; 215/377; 215/400; 215/DIG. 7; 220/630

[58] Field of Search ..... 215/2, 377, DIG. 7, 215/378, 400; 220/630

[56] References Cited

U.S. PATENT DOCUMENTS

| | | | |
|---|---|---|---|
| 2,734,650 | 2/1956 | Meyer | 215/246 |
| 2,990,080 | 6/1961 | Harris | 215/393 X |
| 3,438,116 | 4/1969 | Stengle, Jr. | 215/246 X |
| 3,873,018 | 3/1975 | Donnay | 215/246 X |
| 4,632,273 | 12/1986 | Rhine | 215/DIG. 7 X |
| 4,773,548 | 9/1988 | Deussen | 215/2 |
| 4,984,723 | 1/1991 | Hsu | 215/DIG. 7 X |
| 5,292,018 | 3/1994 | Travisano | 215/246 |
| 5,544,770 | 8/1996 | Travisano | 215/250 X |
| 5,573,134 | 11/1996 | Chenault et al. | 215/250 X |

*Primary Examiner*—Sue A. Weaver
*Attorney, Agent, or Firm*—Swindler, Berlin Shereff Friedman, LLP

[57] ABSTRACT

A container can be configured as either a bottle or a drinking vessel. The bottle has a base which is detachable. A drinking vessel is formed by removing the base from the hollow body of the bottle, inverting the hollow body of the bottle, and reattaching the top of the bottle to the base. In the bottle configuration, a locking band connects the base of the bottle to the hollow body of the bottle. The locking band also acts as a tamper-evident seal.

14 Claims, 4 Drawing Sheets

BEVERAGE CONTAINER/DRINKING VESSEL

FIELD OF THE INVENTION

The present invention relates generally to beverage containers and, more particularly, to containers which can be used as drinking glasses. A bottom of the container is detachable and re-attachable to the top of the container, thereby converting the beverage container to an open mouthed vessel for drinking and diverse storage. Even more particularly, the present invention relates to a container which is re-usable and will be considered a valued collectible, novelty, or marketing tool for manufacturers.

BACKGROUND OF THE INVENTION

Millions of conventional containers are packaged and sold in the United States and abroad. The huge quantities of these containers in circulation daily result in a proliferation of litter and waste because many are never recycled. This is undesirable and also squanders consumers' opportunity to save materials which have lasting value and beauty. Re-usable containers have value not only in their utility, but also because they promote environmental goals.

Conventional containers have a hollow body with two axially opposed ends. Furthermore, most conventional containers also have a cap which is detachably connected to the cap open end. However, conventional containers do not have a base which is detachably connected to the body, and re-attachably connectable to the cap open end. Furthermore, conventional containers are not well adapted for reuse, resulting in wasted resources and overtaxed waste disposal systems.

Conventional containers have been combined with drinking or storage vessels, but they have suffered from the fact that the container and vessel are two separate entities. Because the container and vessel are separate, one may easily become lost. Furthermore, the container may be discarded, while its vessel is retained. It would be desirable to provide a reusable container which includes all essential elements for conversion to an open mouthed vessel for drinking or storage which decreases the likelihood of loss of a part.

SUMMARY OF THE INVENTION

An object of the present invention is to provide a configurable container having a hollow body for storing and distributing liquids and solids in the first configuration and for use as an open mouthed vessel in another configuration.

An object of the present invention is to provide a container which has a hollow body having cap and base open ends, a detent on the body at the base open end for use as a stabilizing mechanism when engaging the body to the base, and a cap detachably connected to the cap open end being re-attachably connectable to the base.

Another object of the present invention is to provide a container with a hollow body having a cap open end for dispensing contents or receiving a cap, and a base which is detachably connected to the base open end of the body and re-attachably connectable to the cap open end.

A third object of the present invention is to provide a container whose base has a center, and further having a centrally disposed threaded socket of sufficient dimensions to permit threadable re-engagement of the base at the cap open end or cap.

Another object of the present invention is to provide a container wherein the detachable base is attached to the body at the base open end with a locking band, threaded band, or other locking seal device circumferentially disposed at the juncture between the base open end and the base.

Yet a further object of the present invention is to provide a container whose body has an integrated locking ridge for attachment of a detachable locking seal, providing stability for the container when the detachable base is engaged at the base open end of the body.

Still another object of the invention is to provide a container in which the locking seal is disengaged with a pull tab.

Yet still a further object of the present invention is to provide a container wherein the detachable base is engaged to the body at the base open end with threads or any other well-known twistable engagement device.

Another object of the present invention is to provide a method for converting a container, with cap and base open ends, the cap open end having a smaller substantially circular area than that of a detachable base at the base open end, to an open mouthed vessel for drinking or storage.

And yet a final object of the present invention is to provide a container wherein only the base may be disengaged from the body to allow outflow or removal of any contents.

According to the present invention, a container includes a hollow body made from any rigid material, such as plastic or glass. The body has two ends, which are axially opposed and open, in order to permit the filling or evacuation of the contents of the body. The cap open end, which might be thought of as the top, is smaller in circumference than the base disposed at the base open end. In one embodiment, for example, the cap open end may be sealed using a removable cap. Alternately, the cap open end may be sealed having no cap, so that the contents may only be dispensed from the base open end, for example.

Detachably connected to the base open end of the body is a base. At the cap open end are external threads, for re-attachment of the base to provide a stand when the container has been converted for use as a vessel. The external threads at the cap open end may be cross-hatched to provide a gripping surface. The base has, in its center, a threaded socket for re-attachment of the base to the cap open end. The socket has sufficient depth to mate with the external threads at the cap open end.

The base may be detachably connected to the body at the base open end in several ways. For example, the base may be detachably connected to the base open end with a locking band, threaded band, or other locking device. The locking device might have a pull tab for disengagement. The locking device may be attached to the body at an integrated locking ridge. The locking device thus provides the necessary edge strength to maintain the container's structural integrity during transit or before the container is opened or converted for use as an open vessel. The locking device may further be circumferentially enclosed by a seal made of a flexible material, for example a plastic. This enclosing seal might prevent the pull tab from opening prematurely.

The base may also be detachably connected to the body by threads. When any threadable locking device is employed, the device would be circumferentially enclosed by a seal made of a flexible material, such as a plastic, as are well known for tamper evident seals. This enclosing seal can provide tamper evidence when any threaded locking device is employed to attach the base to the body of the container. In all embodiments, there must be an internal seal to prevent leaking of the contents of the container, and further to prevent glass-to-glass contact between the body and the base when the base is threaded to the body.

The body, at the base open end, can have internal threads for attaching to the base. The base would have threads disposed along its outer edge for mating to the internal threads at the base open end of the body. When the base is threaded into the interior of the body, enough space must remain on the outer edge of the base to project beyond the base open end. This space provides a gripping area for detaching the base from the base open end of the body.

The base could also be attached to the exterior of the body by threads. When the base is attached to threads on the exterior of the body, the threads on the base must be disposed on the interior of the base.

Alternately, the base could be attached to the body using a threaded band. The threaded band would thread onto the exterior threads on the body, engaging the base to the body. The body threads may be either continuous or non-continuous. The non-continuous variety might be produced to provide a more tactilely pleasing surface at the base open end when that end is used as the lip of a drinking vessel, after the container has been converted.

The cap disposed at the cap open end of the body has external threads for mating to the threaded socket in the base once the base is detached from the base open end. If the cap open end is manufactured closed, then that end will have the same external threads for mating to the base as if there were a cap present.

The body has a lip disposed internally at the base open end to provide a surface for compression of a compressible impermeable seal between the body and the base. The seal will prevent leaking of the materials from the container.

In order to convert the container to an open vessel, the base is detached from the base open end of the body, either by removing the locking device, or by unscrewing to disengage the threads. When the base has been detached, it is re-attached to the cap open end by engaging the threads in the centrally disposed threaded socket of the base to the external mating threads at the cap open end. The container is now ready to be used or reused as an open vessel for drinking, dispensing other materials, or merely as a decorative or novelty item. Note that if the contents of the container have not been removed prior to conversion to a vessel, it is necessary to invert the container before converting it to a vessel.

BRIEF DESCRIPTION OF THE DRAWINGS

In FIG. 5A, the cap open end of the body might be either open and sealed with a cap having external threads or an external locking device, or closed having external threads or an external locking device.

In FIG. 6, the detachably removable base is attached to the body with an internally threaded sleeve.

DETAILED DESCRIPTION OF THE PREFERRED EMBODIMENTS

Figure 1:
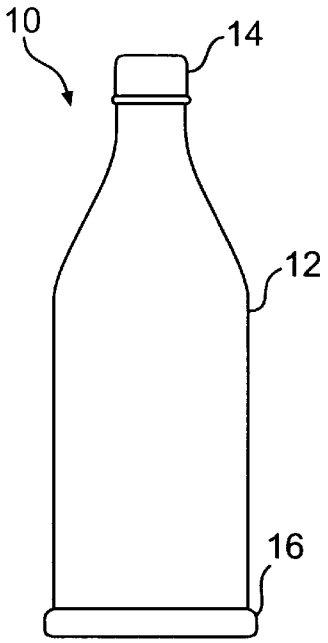
FIG. 1 shows the convertible container prior to conversion to an open mouthed vessel. The example embodiment in FIG. 1 has both a removable cap and detachably removable base.

Referring to FIG. 1, a container (10) has a body (12) with a standard twist-off cap (14) threaded to the cap open end of the body, also having a detachable base (16) attached to the base open end of the body. FIG. 1 shows the detachable base in its closed, sealed and/or locked position. The preferred embodiment of the invention has all three of the elements present in FIG. 1. The body may be made of any rigid material such as glass or plastic. The material may, for example, be blown or molded. The body may be made of one single piece of rigid material, or be comprised of several pieces fused together.

Figure 2:
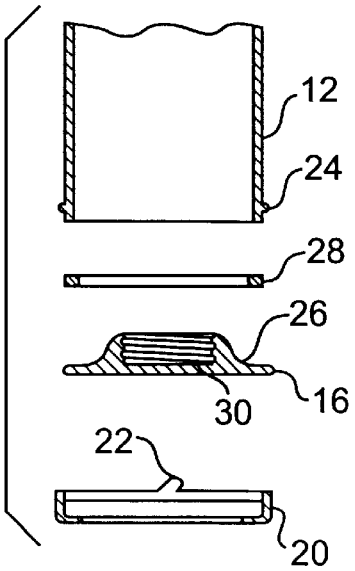
FIG. 2 is a fragmentary view of a container similar to that shown in FIG. 1, displaying the elements of the detachably removable base. The figure illustrates how to engage or disengage the detachably removable base.

FIG. 2 is a view of one assembly of the detachable base (16) showing the locking of the bottom closure to the container bottom. Disassembly is designed to occur when the tear-off locking band (20) is stripped off using the pull tab (22). The detachable base (16) is attached to the body (12) using a detent or similar stabilizing mechanism, such as a tongue-in-groove lock. In FIG. 2, the body has a tongue for the detent (24), which is compressed to a mating detent, or groove, on the detachable base (26). A compressible seal (28) is compressed between the tongue of the body (24) and the groove of the detachable base (26) to prevent leaking of materials from the container. The tear-off locking band (20) circumferentially encloses the detent of the body and the base to provide stability for the whole container before conversion to a vessel or during transport. The tear-off locking band is attached to the body at an integrated locking ridge shown in FIG. 3. The locking ridge helps to provide further stability for the container. Also shown is a centrally disposed threaded socket (30) with internal threads for engagement to the threads located at the cap open and (14) of the body (12) when converting the container to an open mouthed vessel or back again. The detent mechanism is shown more fully in FIG. 4.

Figure 3:
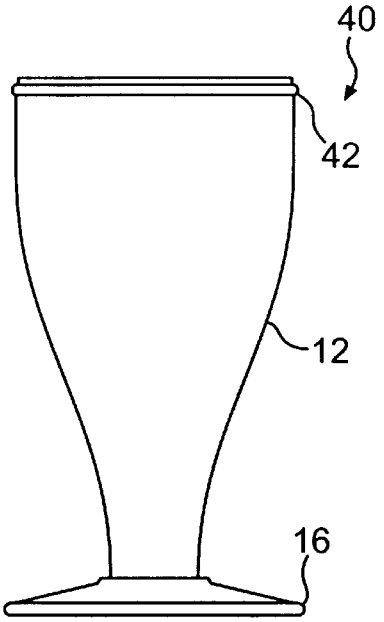
FIG. 3 is view of a container similar to that in FIG. 1 after the container has been converted to an open mouthed vessel.

FIG. 3 shows an assembled open mouthed vessel (40) set on its base (16) after conversion from a container. The body (12) has a locking ridge (42) for attachment to the tear-off locking band shown in FIG. 2. The locking ridge is only decorative once the container has been converted to the open mouthed vessel in FIG. 3.

Figure 4:
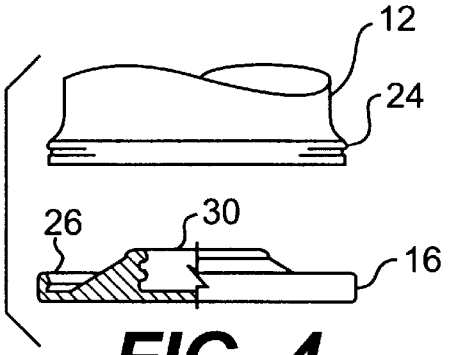
FIG. 4 is a fragmentary view of the base open end of a container substantially similar to that illustrated in FIG. 1, showing a possible alteration in the body structure for engagement of the detachably removable base.

FIG. 4 illustrates another system for engaging the detachable base closure to the body. A tongue (24) on the body (12) mates with a groove (26) on the base (16). This closure is then circumferentially enclosed by the tear-off band (20) shown in FIG. 2. This closure provides the necessary strength to engage the base to the body until the container is converted to an open mouthed vessel.

Figure 5A:
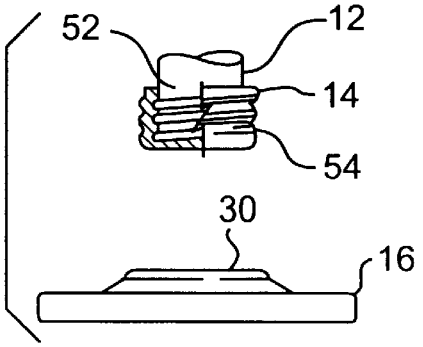
FIG. 5A is a fragmentary view illustrating the engagement process of the cap open end to the base open end for conversion of a container similar to that in FIG. 1 to one like that displayed in FIG. 3.
Figure 5B:
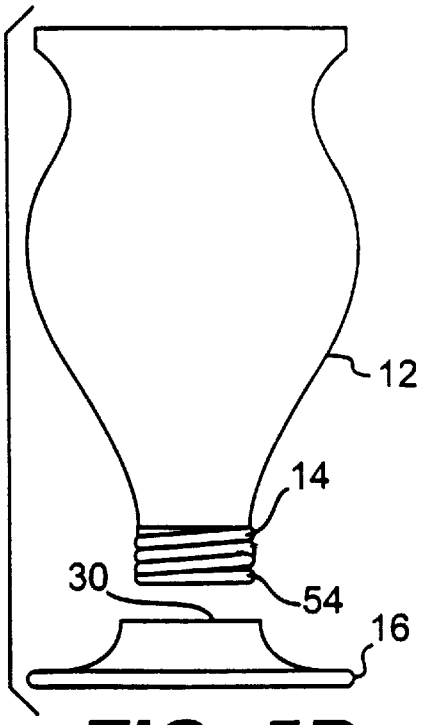
FIG. 5B is a full view of another possible shape embodiment of the container body, further showing the assembly depicted in FIG. 5A.

FIG. 5A shows the cap open end of a body of a container (12) attached to a cap (14) using threads (52). The cap (14) is modified with external threads (54) to engage the suitably matched threads at the socket (30) centrally disposed in the detachable base (16). The external threads at the cap open end (54) may have cross-hatching, as shown in FIG. 5B, to facilitate gripping. The cap may also be modified with some other locking device, such as are well known and commonly found on aspirin bottles, for example. Another of the many possible body shapes where the cap open end has a smaller substantially circular area than the base is shown in FIG. 5A.

FIG. 5A can also be used to illustrate a configuration that eliminates the requirement for a cap. Assume the external threads or locking device (54) at the cap open end of the container (14) are an integral part of the cap open end of the body and there is no opening present at the cap open end. The cap open end may still be threaded or locked into its matching receptacle socket (30) in the detachable base. In this configuration, the only access to fill or evacuate the container is through its bottom.

FIG. 5B shows a full view of FIG. 5A. The body of the container (12) may take on any number of shapes such as tumblers, schooners, snifters, and goblets. The cap open end closure (14) has external threads or a locking device (54) as discussed in FIG. 5A. The external threads or locking device may be cross-hatched to facilitate gripping when removing the cap open end closure (14) or the base (16) at the base open end. The cap open end closure mates with an opposite half in the central socket (30) of the base.

Figure 6:
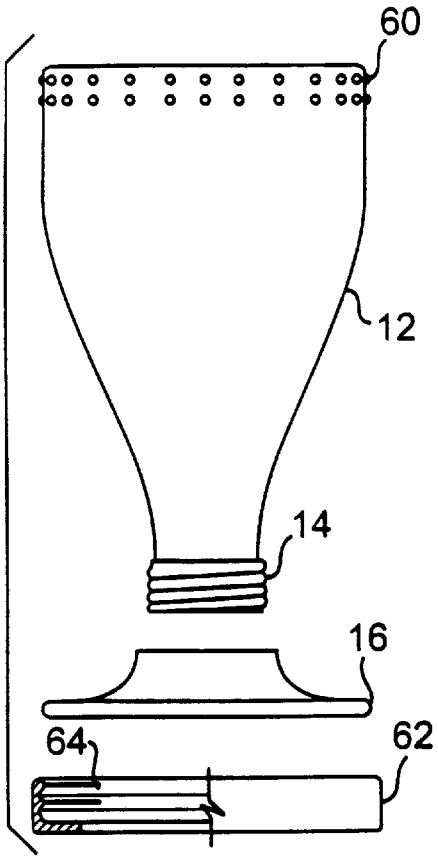
FIG. 6 is a view of a container similar to the one shown in FIG. 3, prior to the completion of the conversion process shown in FIG. 5A.

FIG. 6 shows another possible embodiment for attachment of the base to the body of the container. The body (12) at the base open end might be threaded (60). As shown here, the threads may be non-continuous (60) Non-continuous threads provide a more tactilely pleasing surface when the base open end is used as the lip of a drinking vessel. The base (16) is attached to the body (12) with a threaded sleeve (62). The threaded sleeve (62) threads onto the threads (60) at the base open end of the body with matched threads (64). This compresses the base (16) to the body. When a threaded sleeve is employed as the closure mechanism for the base open end of the body, there would be a need for a tamper evident seal to wrap around the threaded sleeve. The tamper evident seal would improve purchaser confidence when the base is attached with a threaded sleeve.

Figure 7A:
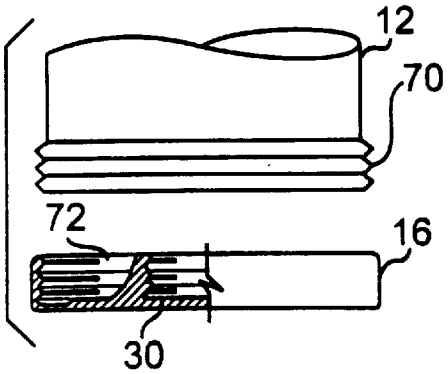
FIG. 7A is a fragmentary view of one possible embodiment example for attaching and detaching the base, at the base open end of the body of the container, with threads.

FIG. 7A depicts yet another embodiment for attaching the base to the body. The base (16) may be threaded to the body (12) at the base open end. The body (12) may have external threads (70) for engagement to internal threads (72) on the base (16). If the base is attached to the body as shown in this Figure, the closure would require a tamper evident seal, as discussed in relation to FIG. 6. The tamper evident seal would increase purchaser confidence, and prevent tampering, when the base is attached in this manner. The base is removed by dis-engaging the base (16) from the body (12) using the threaded closure (70, 72). Once the base has been removed from the body, it is re-attached to the body at the cap open end with the central socket (30), as shown in FIGS. 3 and 5B.

Figure 7B:
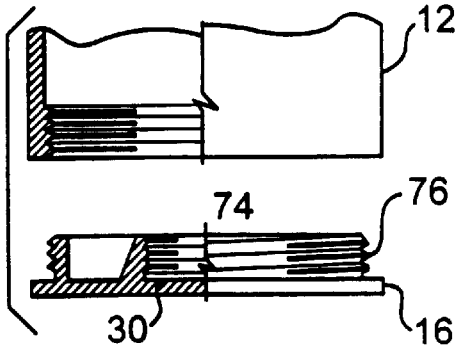
FIG. 7B is a fragmentary view like FIG. 7A, showing another possible embodiment example for attaching and detaching the base, at the base open end of the body of the container, with threads.

FIG. 7B depicts a similar closure mechanism to the one depicted in FIG. 7A. The base (16) may be threaded to the body (12) at the base open end. The body (12) may have internal threads (74) for engagement to external threads (76) on the base (16). If the base is attached to the body as shown in this Figure, the closure would require a tamper evident seal, as discussed in FIG. 6. The tamper evident seal would increase purchaser confidence, and prevent tampering, when the base is attached in this manner. The base is removed by dis-engaging the base (16) from the body (12) using the threaded closure (74, 76). Once the base has been removed from the body, it is re-attached to the body at the cap open end with the central socket (30), as shown in FIGS. 3 and 5B.

Figure 8:
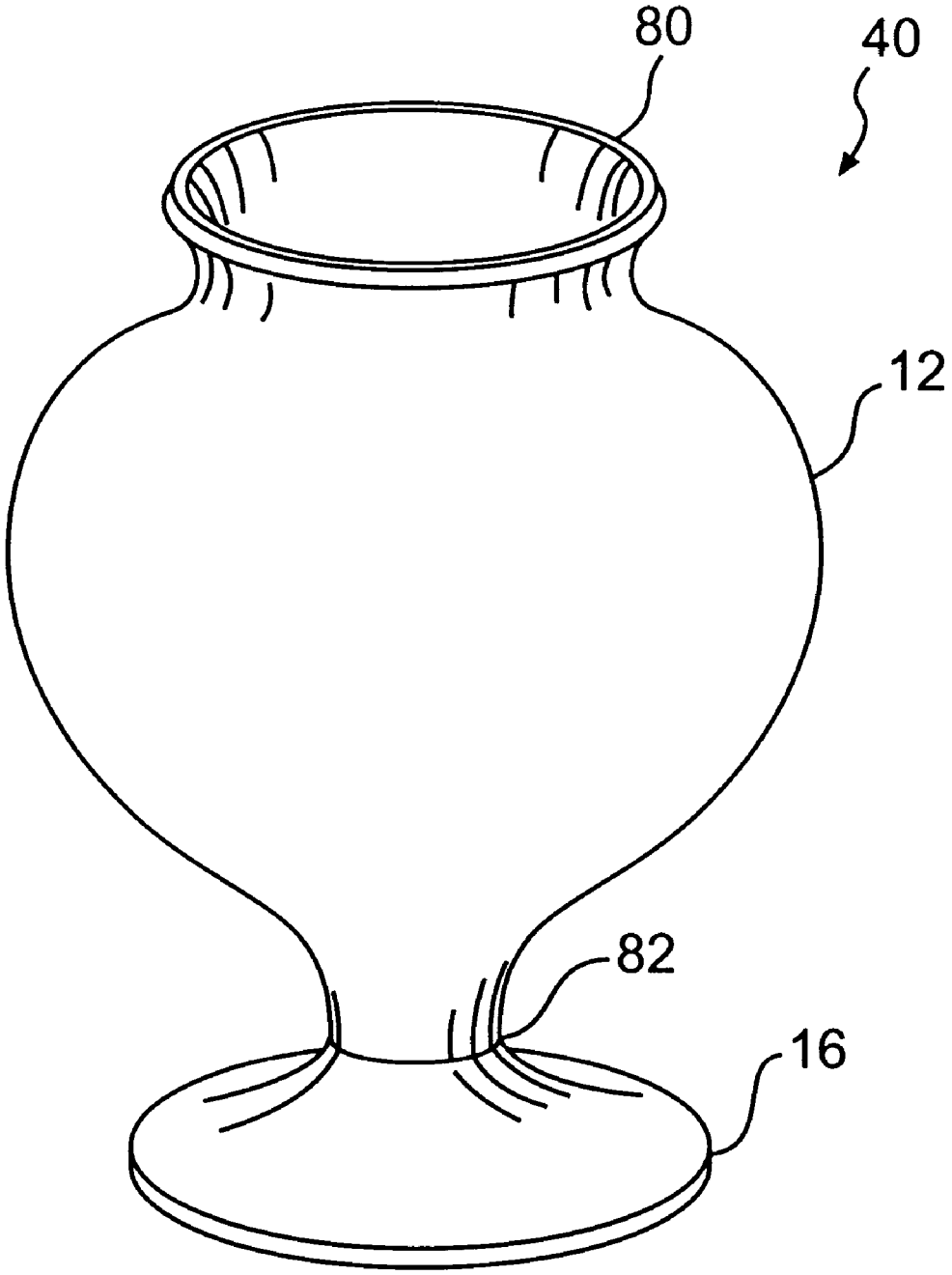
FIG. 8 shows an embodiment of the container with a different body shape than the body shapes depicted in FIGS. 3 and 5B.
Figure 9:
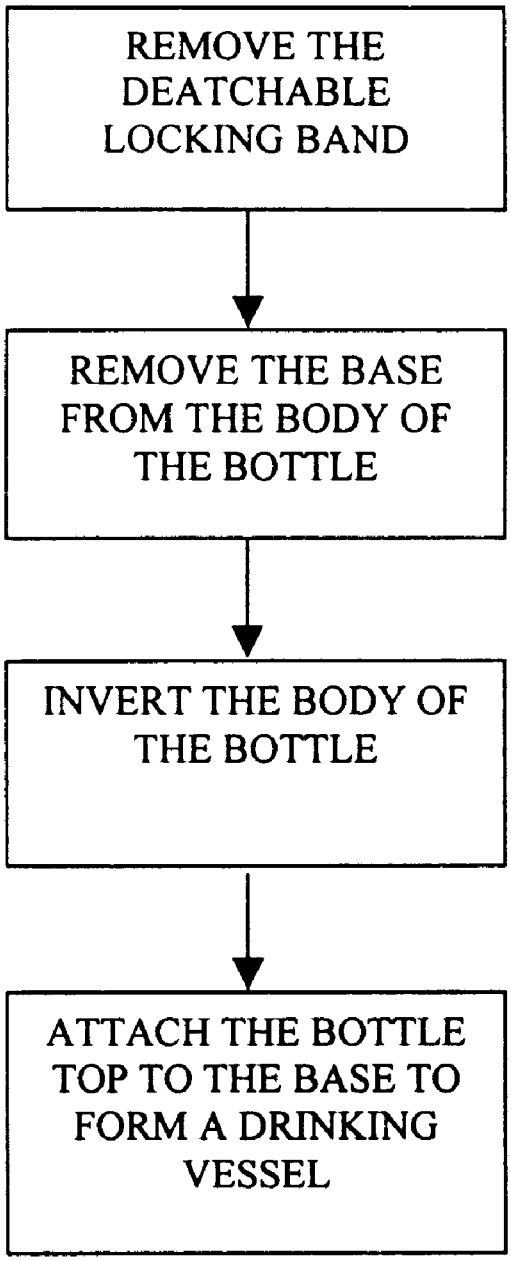
FIG. 9 shows a flow chart detailing a method of converting a bottle into a drinking vessel.

FIG. 8 shows another possible embodiment for the shape of the body. Once the container has been converted to an open mouthed vessel (40), it rests on its base (16). The base open end (80) serves as the mouth for the vessel, and the cap open end (82) is engaged to the base. Virtually any shape of the body is possible. The only limitation is that the base open end be larger than the cap open end.

It is apparent from the foregoing discussion that the invention includes conversion of a container into a vessel. For example, the container may contain a beverage; after the cap is removed, and the contents consumed, the tapered, formerly capped end can be attached to the base to form a drinking glass, vase or any other vessel.

Other variations abound, including one in which the cap is not removable, the container is inverted so that the base-end is up, the base is then removed, the base is attached to the opposite, preferably tapered end of the container, thereby forming a drinking vessel from which the fluid contents may be consumed.

While advantageous embodiments have been chosen to illustrate the invention, it will be understood by those skilled in the art that various changes and modifications can be made therein without departing from the scope of the invention as defined in the appended claims.

What is claimed is:

1. A container configurable as a bottle or a vessel comprising:

an open-ended hollow body having first and second opposite axial ends, the first axial end forming a bottom of the bottle and the second axial end having a reduced pouring neck forming a top of the bottle, the first axial end having a first detent;

a base detachably connected to first axial end, the base having a mating detent for mating with the first detent;

a detachable locking device circumferentially enclosing the first detent and the mating detent for connecting the base to the first axial end and for providing stability for the container while configured as a bottle;

a cap detachably connected to the second axial end; and means for connecting the second axial end to the base to form a vessel.

2. A configurable container according to claim 1, wherein the detachable locking device is a tear-off locking band.

3. A container according to claim 2, wherein the locking device includes a pull tab.

4. A container according to claim 2, wherein the cap includes an externally threaded side wall and the base includes a central, internally threaded socket which engages the externally threaded side wall of the cap.

5. A container according to claim 2, wherein the second axial end of the container has an externally threaded side wall and the cap has an internally threaded side wall which engages the externally threaded side wall of the container.

6. A container according to claim 5, wherein the base has an internally threaded socket which engages the externally threaded side wall of the container.

7. A configurable container according to claim 1, wherein the second axial end of the container includes an externally threaded side wall, and the base includes an internally threaded socket which engages the externally threaded side wall of the second axial end.

8. A configurable container according to claim 7, wherein the internally threaded socket is formed on an inside surface of the base.

9. A configurable container according to claim 1, wherein the first detent is a locking ridge and the mating detent is a groove.

10. A configurable container according to claim 9, further comprising an elastomeric seal disposed between the base and the first axial end of the container.

11. A container according to claim 10, wherein the base is press-fit against the first axial end of the body of the container.

12. A container configurable as a bottle or a vessel comprising:

an open-ended hollow body having first and second opposite axial ends, the first axial end forming a bottom of the bottle and the second axial end having a reduced pouring neck forming a top of the bottle, the first axial end having threads on its exterior;

a base detachably connected to first axial end;

a detachable locking device for connecting the base to the first axial end and for providing stability for the container while configured as a bottle, wherein the detachable locking device is a threaded sleeve that threads onto the threads on the exterior of the first axial end;

a cap detachably connected to the second axial end;

means for connecting the second axial end to the base to form a vessel.

13. The container of claim 12, wherein the threads on the exterior of the first axial end are non-continuous threads.

14. A method of converting a bottle into a vessel, the bottle having an open-ended hollow body having first and second opposite axial ends, the first axial end forming a bottom of the bottle and the second axial end having a reduced pouring neck forming a top of the bottle, a detachable locking device for connecting a detachable base to the first axial end and for providing stability for the container while configured as a bottle;

the method comprising:

removing the detachable locking device;

removing the base from the first axial end of the hollow body; and attaching the second axial end of the hollow body to the base, thereby forming a vessel, the base having a receptacle with means for connecting to the second axial end.

* * * * *

UNITED STATES PATENT AND TRADEMARK OFFICE

CERTIFICATE OF CORRECTION

PATENT NO : 6,164,473

DATED : December 26, 2000

INVENTOR(S) : R. Leland Waldrip

It is certified that error appears in the above-identified patent and that said Letters Patent are hereby corrected as shown below:

Title page,

The Attorney, Agent or Firm is corrected to read --Swidler Berlin Shereff Friedman, LLP--.

Signed and Sealed this

First Day of May, 2001

*Attest:*

Nicholas P. Godici

NICHOLAS P. GODICI

*Attesting Officer*

*Acting Director of the United States Patent and Trademark Office*